US009862016B2

(12) United States Patent
Kawamoto et al.

(10) Patent No.: US 9,862,016 B2
(45) Date of Patent: Jan. 9, 2018

(54) MANDREL

(71) Applicant: MITSUBISHI AIRCRAFT CORPORATION, Aichi (JP)

(72) Inventors: Hiroshi Kawamoto, Tokyo (JP); Toyoaki Yasui, Tokyo (JP); Kunihiro Kuroi, Tokyo (JP); Tomone Kishida, Aichi (JP)

(73) Assignee: MITSUBISHI AIRCRAFT CORPORATION, Aichi (JP)

( * ) Notice: Subject to any disclaimer, the term of this patent is extended or adjusted under 35 U.S.C. 154(b) by 0 days.

(21) Appl. No.: 15/060,101

(22) Filed: Mar. 3, 2016

(65) Prior Publication Data

US 2016/0256909 A1 Sep. 8, 2016

(30) Foreign Application Priority Data

Mar. 4, 2015 (JP) ..... 2015-041920

(51) Int. Cl.

| | |
|---|---|
| ***B21B 19/04*** | (2006.01) |
| ***B21D 9/07*** | (2006.01) |
| ***B21B 25/00*** | (2006.01) |
| ***B21D 37/01*** | (2006.01) |

(52) U.S. Cl.

CPC ..... *B21D 9/073* (2013.01); *B21B 19/04* (2013.01); *B21B 25/00* (2013.01); *B21D 37/01* (2013.01)

(58) Field of Classification Search

CPC ..... B21D 9/073; B21D 37/01; B21B 19/04; B21B 25/00

USPC ..... 72/96, 97

See application file for complete search history.

(56) References Cited

U.S. PATENT DOCUMENTS

| | | | | |
|---|---|---|---|---|
| 4,466,265 | A * | 8/1984 | Wessel | B22D 19/06 164/99 |
| 5,031,434 | A * | 7/1991 | Takase | B21B 25/00 72/209 |
| 5,687,604 | A * | 11/1997 | Robbins | B21C 23/217 72/265 |
| 7,383,710 | B2 * | 6/2008 | Yamakawa | B21B 25/00 72/209 |
| 9,283,600 | B2 * | 3/2016 | Yamane | B21B 25/00 |

FOREIGN PATENT DOCUMENTS

| | | |
|---|---|---|
| JP | 2012-166246 | 9/2012 |

* cited by examiner

*Primary Examiner* — David B Jones

(74) *Attorney, Agent, or Firm* — Pearne & Gordon LLP

(57) ABSTRACT

Provided is a mandrel which is inserted into a pipe material when the pipe material is bent, the mandrel including: a core member having a rod-shaped main body portion and a small-diameter portion which is provided on one end side of the main body portion and which is thinner than the main body portion; and a front end member which is provided on one end side of the core member and which is formed integrally with the core member so as to cover the small-diameter portion.

5 Claims, 2 Drawing Sheets

MANDREL

TECHNICAL FIELD

The present invention relates to a mandrel which is inserted into a pipe material when the pipe material is bent.

BACKGROUND ART

As a bending machine for bending a pipe (pipe material) to a predetermined curvature, for example, a bending machine is known which includes a first supporting portion configured to support a part of a pipe on one end side thereof and a second supporting portion configured to support a part of the pipe on the other end side thereof, and which is configured to bend the pipe along an arc-shaped guide face provided on the first supporting portion by rotating the first supporting portion about a predetermined rotation axis and also causing the second supporting portion to linearly move.

Such a bending machine is equipped with a mandrel for preventing the deformation (flattening) of a pipe at bending, and a pipe is bent with the mandrel inserted in the pipe.

In the bending of a pipe using a mandrel, lubricant oil is used in some cases to reduce the sliding friction between the inner surface of the pipe and the mandrel and to prevent the formation of scratches on the inner surface of the pipe. However, since the lubricant oil is attached to the inner surface of the pipe, the bending using lubricant oil requires a washing operation for removing the lubricant oil by washing the inside of the pipe after the bending.

Here, to avoid the use of lubricant oil at the bending of a pipe and to eliminate the need for the washing operation for removing the lubricant oil, a technique has been developed in which a synthetic resin such as MC nylon is provided to a front end portion of a mandrel. The technique in which a synthetic resin such as MC nylon is provided is described in, for example, Patent Literature 1.

CITATION LIST

Patent Literature

{Patent Literature 1} Japanese Patent Application Publication No. 2012-166246

SUMMARY OF INVENTION

Technical Problem

Patent Literature 1 discloses a mandrel including: a cylindrical main body made of a tool steel and provided with a male-screw portion; and a semi-sphere shaped spherical portion made of a synthetic resin (MC nylon) and provided with a female-screw portion, the main body and the spherical portion being assembled together by screw fastening.

However, in the case of the mandrel described in Patent Literature 1, the spherical portion of the mandrel may be deformed because of the formation of a space at a screw-fastened portion between the main body and the spherical portion.

In addition, in the case of the mandrel described in Patent Literature 1, the process for forming the male-screw portion in the main body and the process for forming the female-screw portion in the spherical portion are conducted separately from each other. Hence, the central axes of the main body and the spherical portion may be misaligned, when the male-screwportion and the female-screwportion are screw fastened. The misalignment of the central axes of the main body and the spherical portion not only exerts an influence on the precision of the bending, but also influences the strength of the mandrel. Note that, for the alignment of the central axes, it is necessary to conduct the process for forming the male-screw portion in the main body and the process for forming the female-screw portion in the spherical portion with high precision.

The present invention has been made in view of the above-described problems, and an object of the present invention is to keep a shape of a mandrel including two members.

Solution to Problem

A first aspect of the invention, with which the problems are solved, provides a mandrel which is inserted into a pipe material when the pipe material is bent, the mandrel comprising: a core member having a rod-shaped main body portion and a small-diameter portion which is provided on one end side of the main body portion and which is thinner than the main body portion; and a front end member which is provided on one end side of the core member and which is formed integrally with the core member so as to cover the small-diameter portion.

A second aspect of the invention, with which the problems are solved, provides the mandrel according to the first aspect of the invention, wherein the front end member is a resin member formed by injection molding.

A third aspect of the invention, with which the problems are solved, provides the mandrel according to the first aspect of the invention, wherein the front end member is a ceramic member formed by sintering.

A fourth aspect of the invention, with which the problems are solved, provides the mandrel according to the first aspect of the invention, wherein the small-diameter portion has a groove portion, and the front end member is formed on the core member so as to fill the groove portion.

Advantageous Effects of Invention

According to the mandrel according to the first aspect of the invention, the mandrel including the core member and the front end member is configured such that the front end member is not mounted on the core member by press fitting, screw fastening, or the like, but the front end member is formed integrally with the core member so as to cover the small-diameter portion of the core member. This improves the degree of closeness of contact between the core member and the front end member, and makes it possible to keep the shape of the mandrel. In addition, since the front end member is not mounted on the core member by press fitting, screw fastening, or the like, but the front end member is formed integrally with the core member, it is possible to reduce the misalignment of the central axes of the core member and the front end member, and this makes it possible to keep the shape of the mandrel.

According to the mandrel according to the second aspect of the invention, a front end member made of a resin is formed by injection molding. This makes it possible to surely form the front end member on the core member in a close contact state. In addition, the resin member improves the slidability between the mandrel and a pipe material to be bent. Hence, no lubricant oil is used at the bending of a pipe material, which makes it possible to eliminate the need for the washing operation for removing lubricant oil.

According to the mandrel according to the third aspect of the invention, a front end member made of a ceramic is formed by sintering. This makes it possible to surely form the front end member on the core member in a close contact state. In addition, the ceramic member improves the slidability between the mandrel and a pipe material to be bent. Hence, no lubricant oil is used at the bending of a pipe material, which makes it possible to eliminate the need for the washing operation for removing lubricant oil.

According to the mandrel according to the fourth aspect of the invention, the groove portion is provided in the small-diameter portion of the core member, and hence the front end member is formed, while entering the groove portion. Hence, the groove portion acts as a retainer. In other words, when a force acts on the core member in the mandrel in a direction to release the front end member, the front end member is caught by the groove portion in the core member, and does not come off from the core member.

DESCRIPTION OF EMBODIMENTS

Hereinafter, embodiments of mandrels according to the present invention will be described in detail with reference to the attached drawings. As a matter of course, the present invention is not limited to the embodiments described below, and, needless to say, various modifications can be made within a range not departing from the gist of the present invention.

{First Embodiment}

A structure of a bending machine equipped with a mandrel according to a first embodiment of the present invention is described with reference to FIGS. 1A and 1B and FIG. 2.

Figure 1A:
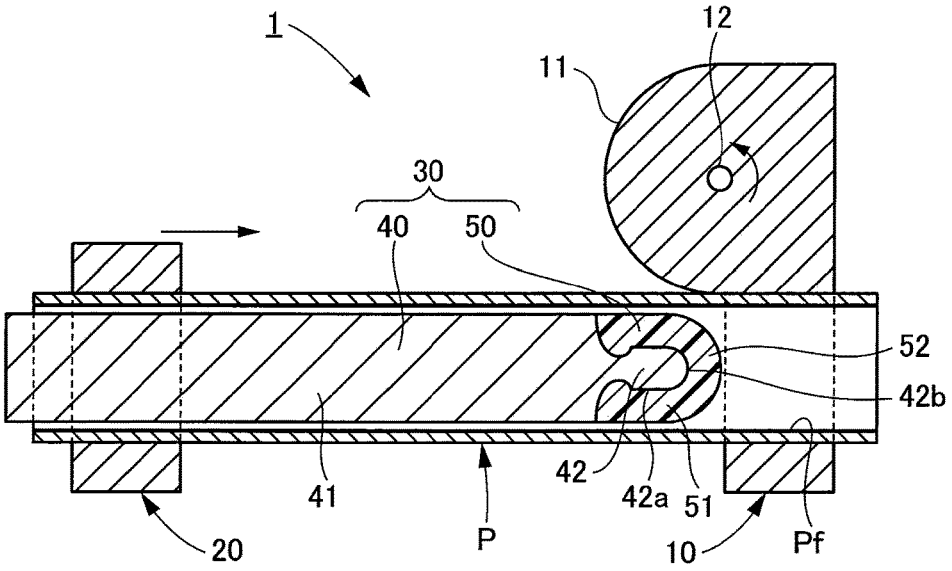
FIG. 1A is a view illustrating a structure of a bending machine (before operation) equipped with a mandrel according to a first embodiment.

As shown in FIG. 1A, a bending machine 1 includes a first supporting portion 10 configured to support a part of a pipe (pipe material) P on a front end side of the pipe P (on the right side in FIG. 1A), and a second supporting portion 20 configured to support a part of the pipe P on a rear end side of the pipe P (on the left side in FIG. 1A).

The first supporting portion 10 has a guide face 11 having an arc shape with a predetermined curvature. The first supporting portion 10 is rotatable about a rotation axis 12 positioned at a center of the arc of the guide face 11. On the other hand, the second supporting portion 20 is configured to linearly move with the rotation of the first supporting portion 10 to push the pipe P toward the front end (in a direction of a tangent to the guide face 11). Accordingly, the pipe P is bent along the guide face 11 of the first supporting portion 10 by the rotation of the first supporting portion 10 and by the linear movement of the second supporting portion 20.

The bending machine 1 is provided with a mandrel 30 for preventing the pipe P from collapsing under pressure during the bending. The mandrel 30 is configured to be inserted into the pipe P supported by the first supporting portion 10 and the second supporting portion 20.

Accordingly, when the straight pipe P is bent to a predetermined curvature, the part of the pipe P on the front end side (the one end side) is supported by the first supporting portion 10, and the part of the pipe P on the rear end side (the other end side) is supported by the second supporting portion 20, as shown in FIG. 1A. In addition, the mandrel 30 is inserted into the pipe P. In this state, the second supporting portion 20 is then linearly moved, and also the first supporting portion 10 is rotated about the rotation axis 12 by a predetermined angle (90° in FIG. 1B), as shown in FIG. 1B. In this manner, a bent portion Pc with the predetermined curvature can be formed in the pipe P, while the flattening of the pipe P is prevented.

The mandrel 30 includes a core bar (core member) 40 having a substantially cylindrical shape (rod-like shape), and a front end member 50 which is provided on one end side of the core bar 40 (on the right side in FIG. 1A), i.e., provided in a range where the mandrel 30 can come into contact with an inner surface Pf of the pipe P during the bending.

The core bar 40 includes a main body portion 41 which has a cylindrical shape (rod-like shape) with an outer diameter $D_1$ insertable into the pipe P, and a small-diameter portion 42 which is provided on one end side of the main body portion 41 (on the right side in FIG. 1A) and which is thinner than the main body portion 41 (which has an outer diameter $D_2$ smaller than the outer diameter $D_1$). Note that the core bar 40 is made of a material having a high rigidity enough to withstand a high pressure applied by the pipe P at the bending of the pipe P. The material of the core bar 40 may be, for example, a metal such as an aluminium bronze or a tool steel.

The front end member 50 is formed integrally with the core bar 40 so as to cover the small-diameter portion 42 of the core bar 40. The front end member 50 includes a tubular portion 51 which has an outer diameter substantially the same as the outer diameter $D_1$ of the main body portion 41 of the core bar 40 and which covers a circumferential surface 42*a* of the small-diameter portion 42 of the core bar 40, and a semi-sphere portion 52 which is provided on a front end side of the tubular portion 51 and which covers an end surface 42*b* of the small-diameter portion 42 of the core bar 40. Note that the front end member 50 is made of a material having a good slidability to reduce the sliding friction of the pipe P on the inner surface Pf at the bending. The material of the front end member 50 may be, for example, a resin having a good slidability, such as a phenolic resin.

The front end member 50 is formed integrally with the core bar 40 by injection molding. In the mandrel 30, the core bar 40 and the front end member 50 are in close contact with each other, with no space therebetween. An example of a method for manufacturing the mandrel 30, i.e., a method for forming the front end member 50 integrally with the core bar 40 is described below.

Figure 2:
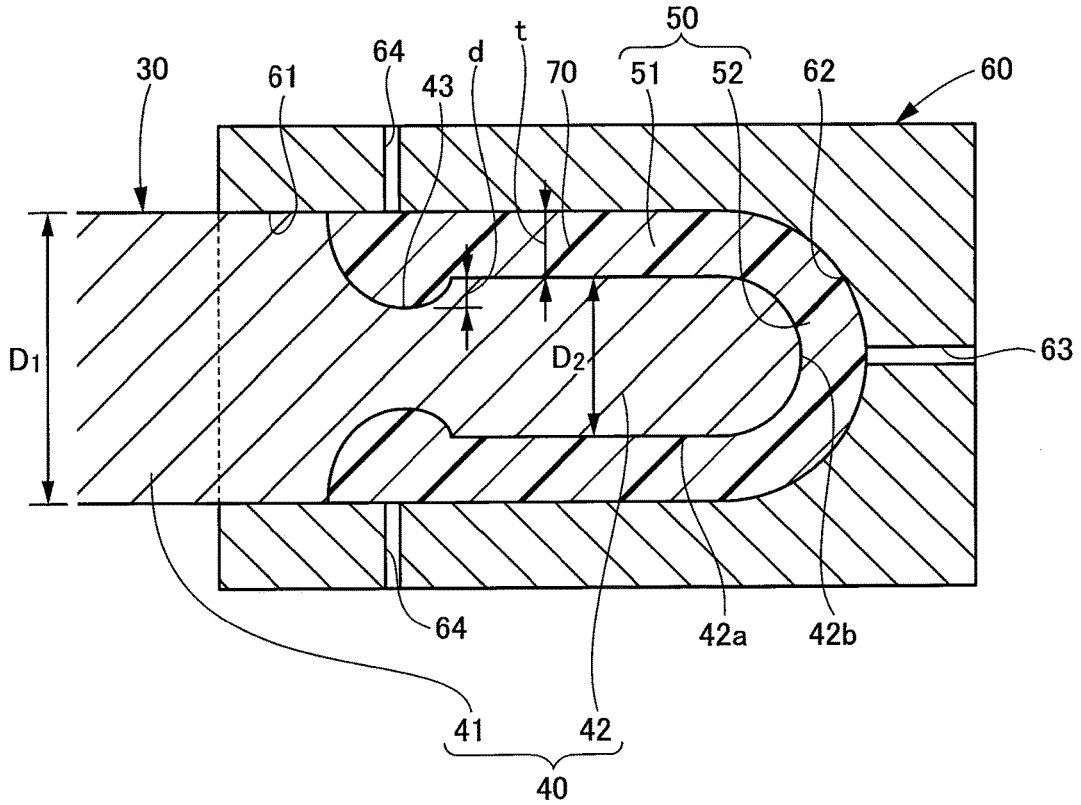
FIG. 2 is a view illustrating the mandrel according to the first embodiment.

First, as shown in FIG. 2, a mold 60 for injection molding is attached to the core bar 40 made of a metal by rolling or the like. This mold 60 has a circumferential surface portion 61 which is open with an inner diameter substantially the same as the outer diameter $D_1$ of the main body portion 41 of the core bar 40. A semi-spherical portion 62 having an inner diameter substantially the same as the inner diameter of the circumferential surface portion 61 is provided at a bottom portion of the mold 60 (a portion on the right side in FIG. 2). Accordingly, in a state where the mold 60 is attached to the core bar 40, a space portion 70 to which the resin can be injected is formed between the mold 60 and the core bar 40.

In the mold 60, a resin injection port 63 opened to a front end side (the right side in FIG. 2) of the semi-spherical portion 62 and an air vent 64 opened to the circumferential surface portion 61 are formed. When a molten resin is injected through the resin injection port 63 to the space portion 70, air in the space portion 70 is released through the air vent 64, so that the space portion 70 is filled with the resin. As described above, the mold 60 is attached to the core bar 40, and the resin is injected to the space portion 70 formed between the core bar 40 and the mold 60. In this manner, the front end member 50 is formed integrally with the core bar 40.

In addition, a groove portion 43 extending in a circumferential direction is formed on the circumferential surface 42*a* of the small-diameter portion 42 of the core bar 40. The front end member 50 is provided so as to fill the groove portion 43. Accordingly, the resin solidified in the groove portion 43 acts as a retainer of the front end member 50. In other words, when a force acts on the core bar 40 in the mandrel 30 in a direction to release the front end member 50, the front end member 50 is caught by the groove portion 43 of the core bar 40, and hence is prevented from coming off from the core bar 40.

As described above, the front end member 50 made of the resin is formed integrally with the core bar 40 by injection molding. This makes it possible to surely bring the front end member 50 into close contact with the core bar 40, and also makes it possible to easily align shaft centers of the core bar 40 and the front end member 50.

Note that, when a front end member is mounted on a core member by press fitting, screw fastening, or the like as in the conventional case, the front end member may be deformed, because a space is created between the core member and the front end member, and also because the central axis of the core member and the central axis of the front end member are misaligned. In addition, to align the central axis of the core member and the central axis of the front end member in the mounting of the front end member on the core member by press fitting, screw fastening, or the like, it is necessary to process the core member and the front end member with high precision.

Operations of the bending machine equipped with the mandrel 30 according to the first embodiment of the present invention are described with reference to FIGS. 1A and 1B and FIG. 2.

First, a pipe P is set to the bending machine 1 as shown in FIG. 1A. In other words, apart of the pipe P on the front end side is supported by the first supporting portion 10, and apart of the pipe P on the rear end side is supported by the second supporting portion 20. In addition, the mandrel 30 is inserted into the pipe P supported by the first supporting portion 10 and the second supporting portion 20.

Next, the first supporting portion 10 is rotated about the rotation axis 12 (counterclockwise in FIG. 1A), and also the second supporting portion 20 is linearly moved with the rotation (moves to the right in FIG. 1A). Here, the position of the mandrel 30 in the bending machine 1 is unchanged, but the pipe P slides with respect to the mandrel 30 (slides to the right in FIG. 1A, as in the case of the second supporting portion 20).

Figure 1B:
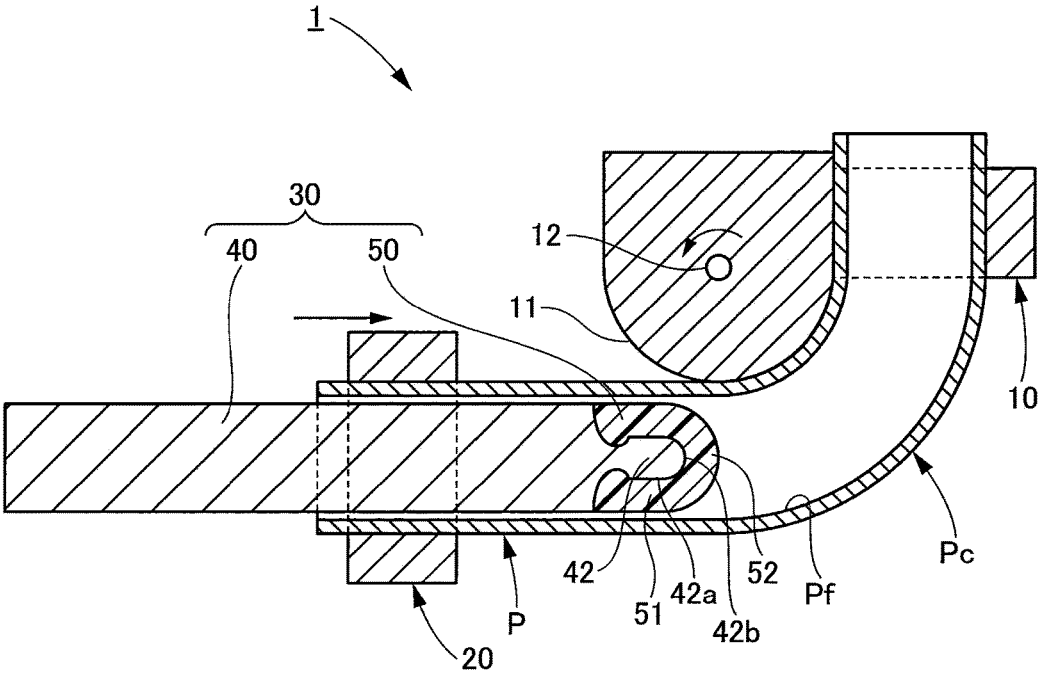
FIG. 1B is a view illustrating a structure of the bending machine (after operation) equipped with the mandrel according to the first embodiment.

Then, as shown in FIG. 1B, the first supporting portion 10 is rotated by a predetermined angle (90° in FIG. 1B), and also the second supporting portion 20 is linearly moved to an extent corresponding to the rotation of the first supporting portion 10. In this manner, a bent portion Pc with the predetermined angle (90° in FIG. 1B) is formed in the pipe P.

In the mandrel 30, the front end member 50 is formed integrally with the core bar 40 by injection molding. Hence, the core bar 40 and the front end member 50 are surely brought into close contact with each other, with no space therebetween. In addition, the central axes of the core bar 40 and the front end member 50 are aligned. Accordingly, a sufficient strength is provided to the front end member 50, so that the front end member 50 is not broken by the pressure, friction, or the like applied by the pipe P at the bending.

In addition, the groove portion 43 is provided on the circumferential surface 42*a* of the small-diameter portion 42 of the core bar 40, and the front end member 50 is provided so as to fill the groove portion 43. Hence, even when a force acts on the core bar 40 in a direction to release the front end member 50, the front end member 50 is caught by the groove portion 43 of the core bar 40, and hence does not come off from the core bar 40.

In the mandrel 30 according to this embodiment, the groove portion 43 extending in the circumferential direction is formed on the circumferential surface 42*a* of the small-diameter portion 42 of the core bar 40. However, the groove portion in the present invention is not limited thereto, but may be any, as long as the groove portion can act as a retainer of the front end member 50 formed integrally with the core bar 40. As the groove portion of the present invention, for example, multiple groove portions 43 arranged in an axial direction and each extending in the circumferential direction may be provided on the circumferential surface 42*a* of the small-diameter portion 42 in the mandrel 30, or a notched portion may be provided by cutting a part of the circumferential surface 42*a* of the small-diameter portion 42 in the mandrel 30.

Note that, to keep the strength of the resin solidified in the groove portion 43, i.e., to sufficiently exhibit the effect of preventing the front end member 50 from coming off, the groove portion 43 preferably has an obtuse angle or a curved surface, and the depth (the length in the radial direction) d of the groove portion 43 is preferably about 50 to 100% of a thickness t to which the front end member 50 is formed.

In addition, to provide a sufficient strength to the small-diameter portion 42 of the core bar 40, and a sufficient strength to the front end member 50 provided on the small-diameter portion 42, the diameter $D_1$ of the main body portion 41 and the diameter $D_2$ of the small-diameter portion 42 in the core bar 40 are preferably such that $D_2 \approx D_1/2$, and it is preferable that $t \approx D_2/2 \approx D_1/4$, where t represents the thickness to which the front end member 50 is formed.

{Second Embodiment}

A structure of a bending machine equipped with a mandrel according to a second embodiment of the present invention is described with reference to FIGS. 1A and 1B and FIG. 3.

A mandrel 130 according to this embodiment is provided instead of the mandrel 30 in the bending machine 1 in the first embodiment of the present invention (see FIGS. 1A and 1B). Specifically, the bending machine equipped with the mandrel 130 according to this embodiment has the same structure as that of the bending machine 1 equipped with the mandrel 30 according to the first embodiment of the present invention, except for the structure of the mandrel 130, specifically, except that a front end member 150 of the mandrel 130 is made of a ceramic instead of the resin. Accordingly, overlapping descriptions for similar structures in the bending machine equipped with the mandrel 130 according to this embodiment to those in the first embodiment are omitted, as appropriate.

Figure 3:
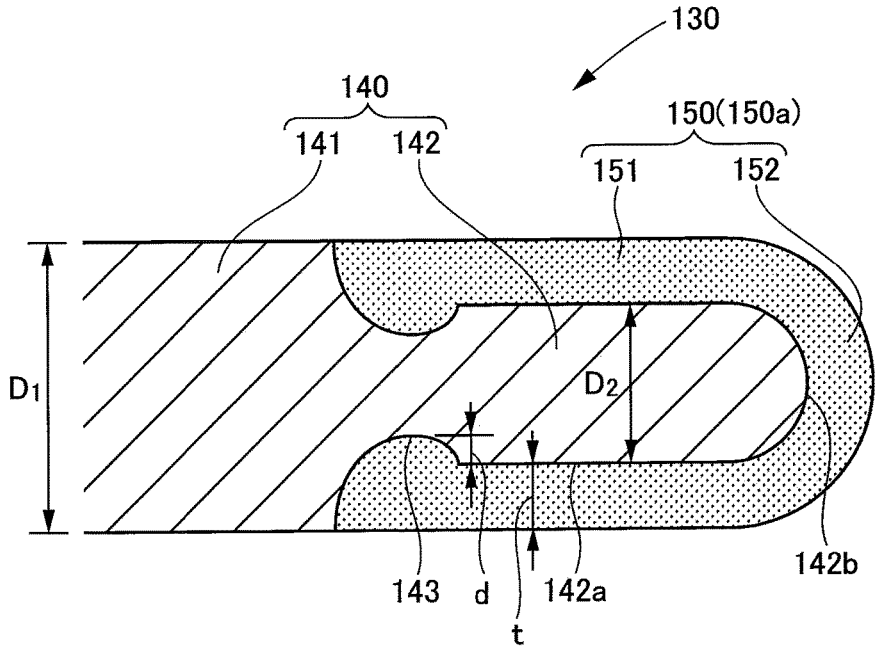
FIG. 3 is a view illustrating a mandrel according to a second embodiment.

The mandrel 130 includes a core bar 140 having a substantially cylindrical shape (rod-like shape) and the front end member 150 provided on one end side of the core bar 140 (on the right side in FIG. 3). Here, the core bar 140 has the same structure as that of the core bar 40 of the mandrel 30 according to the first embodiment, and hence no detailed description of the core bar 140 is provided.

The front end member 150 is formed integrally with the core bar 140 so as to cover a small-diameter portion 142 in the core bar 140. The front end member 150 includes a tubular portion 151 which has an outer diameter substantially the same as an outer diameter $D_1$ of a main body portion 141 of the core bar 140 and which covers a circumferential surface 142*a* of the small-diameter portion 142 of the core bar 140, and a semi-sphere portion 152 which is provided on a front end side of the tubular portion 151 and which covers an end surface 142*b* of the small-diameter portion 142 of the core bar 140. Note that the front end member 150 is made of a material having a good slidability to reduce the sliding friction of the pipe P on the inner surface Pf at the bending. The material of the front end member 150 may be, for example, a ceramic.

The front end member 150 is formed integrally with the core bar 140 by sintering. In the mandrel 130, the core bar 140 and the front end member 150 are in close contact with each other, with no space therebetween. An example of a method for manufacturing the mandrel 130, i.e., a method for forming the front end member 150 integrally with the core bar 140 is described below.

On the core bar 140 made of a metal by rolling or the like, a ceramic powder 150*a* is molded under pressure by using an unillustrated mold, and sintered by heating at high temperature. In this manner, the front end member 150 is formed integrally with the core bar 140, as shown in FIG. 3.

In addition, a groove portion 143 extending in a circumferential direction is formed on the circumferential surface 142*a* of the small-diameter portion 142 of the core bar 140, and the ceramic powder 150*a* is molded under pressure so as to fill this groove portion 143. For this reason, the ceramic sintered in the groove portion 143 acts as a retainer of the front end member 150. In other words, when a force acts on the core bar 140 in the mandrel 130 in a direction to release the front end member 150, the front end member 150 is caught by the groove portion 143 of the core bar 140, and does not come off from the core bar 140.

As described above, the front end member 150 made of a ceramic by the molding under pressure and by the sintering is formed integrally with the core bar 140. This makes it possible to surely bring the core bar 140 and the front end member 150 into close contact with each other, and also makes it possible to easily align shaft centers of the core bar 140 and the front end member 150.

In the mandrel 130 according to this embodiment, the groove portion 143 extending in the circumferential direction is formed on the circumferential surface 142*a* of the small-diameter portion 142 of the core bar 140. However, the groove portion in the present invention is not limited thereto, but may be any, as long as the groove portion can act as a retainer of the front end member 150 formed integrally with the core bar 140. As the groove portion of the present invention, for example, multiple groove portions 143 arranged in an axial direction and each extending in the circumferential direction may be provided on the circumferential surface 142*a* of the small-diameter portion 142 in the mandrel 130, or a notched portion may be provided by cutting a part of the circumferential surface 142*a* of the small-diameter portion 142 in the mandrel 130.

Note that, to keep the strength of the ceramic sintered in the groove portion 143, i.e., to sufficiently exhibit the effect of preventing the front end member 150 from coming off, the groove portion 143 preferably has an obtuse angle or a curved surface, and the depth (length in the radial direction) d of the groove portion 143 is preferably about 50 to 100% of a thickness t to which the front end member 150 is formed.

In addition, to provide a sufficient strength to the small-diameter portion 142 of the core bar 140 and a sufficient strength to the front end member 150 provided to the small-diameter portion 142, the diameter $D_1$ of the main body portion 141 and the diameter $D_2$ of the small-diameter portion 142 in the core bar 140 are preferably such that $D_2 \approx D_1/2$, and it is preferable that $t \approx D_2/2 \approx D_1/4$, where t represents the thickness of the front end member 150 formed.

REFERENCE SIGNS LIST

1 BENDING MACHINE
10 FIRST SUPPORTING PORTION
11 GUIDE FACE OF FIRST SUPPORTING PORTION
12 ROTATION AXIS OF FIRST SUPPORTING PORTION
20 SECOND SUPPORTING PORTION
30 MANDREL
40 CORE BAR (CORE MEMBER)
41 MAIN BODY PORTION OF CORE BAR
42 SMALL-DIAMETER PORTION OF CORE BAR
42A CIRCUMFERENTIAL SURFACE OF SMALL-DIAMETER PORTION
42B END SURFACE OF SMALL-DIAMETER PORTION
43 GROOVE PORTION OF CORE BAR
50 FRONT END MEMBER
51 TUBULAR PORTION OF FRONT END MEMBER
52 SEMI-SPHERE PORTION OF FRONT END MEMBER
60 MOLD FOR INJECTION MOLDING
61 CYLINDRICAL OPENING PORTION OF MOLD
62 SEMI-SPHERICAL PORTION OF MOLD
63 RESIN INJECTION PORT
64 AIR VENT
70 SPACE PORTION
P PIPE (PIPE MATERIAL)
PC BENT PORTION OF PIPE
PF INNER SURFACE OF PIPE

The invention claimed is:

1. A mandrel which is inserted into a pipe material when the pipe material is bent in a bending machine, the mandrel comprising:

a core member having a rod-shaped main body portion and a small-diameter portion which is provided on one end side of the main body portion and which is thinner than the main body portion; and a front end member which is provided on one end side of the core member and which is formed integrally with the core member so as to cover the small-diameter portion, wherein each of the core member and the front end member is made of a solid structure configured to prevent fluid flow through the core member and the front end member, the core member is formed so as not to come off the bending machine at the time of bending, the small-diameter portion has a groove portion, and the front end member is formed on the core member so as to fill the groove portion and come into close contact with the small-diameter portion with no space therebetween, and to keep the front end member from coming off in case of an action of a force in a direction to release the front end member from the small-diameter portion at the time of bending.

2. The mandrel according to claim 1, wherein the front end member is a resin member formed by injection molding.

3. The mandrel according to claim 1, wherein the front end member is a ceramic member formed by sintering.

4. The mandrel according to claim 1, wherein a diameter $D_1$ of the main body portion and a diameter $D_2$ of the small-diameter portion satisfy $D_2 \approx D_1/2$.

5. The mandrel according to claim 1, wherein the front end member is made of a resin.

* * * * *